US006736937B2

(12) United States Patent
Björkstedt et al.

(10) Patent No.: US 6,736,937 B2
(45) Date of Patent: May 18, 2004

(54) METHOD AND APPARATUS FOR CONTROLLING THE OPERATION OF THE SHORT CIRCULATION OF A PAPER, PAPERBOARD OR THE LIKE PRODUCTION MACHINE

(75) Inventors: Lasse Björkstedt, Savonlinna (FI); Jouni Matula, Savonlinna (FI)

(73) Assignee: Andritz Oy, Helsinki (FI)

( * ) Notice: Subject to any disclaimer, the term of this patent is extended or adjusted under 35 U.S.C. 154(b) by 93 days.

(21) Appl. No.: 10/168,322

(22) PCT Filed: Dec. 15, 2000

(86) PCT No.: PCT/FI00/01100

§ 371 (c)(1),
(2), (4) Date: Jul. 16, 2002

(87) PCT Pub. No.: WO01/46521

PCT Pub. Date: Jun. 28, 2001

(65) Prior Publication Data

US 2003/0106660 A1 Jun. 12, 2003

(30) Foreign Application Priority Data

Dec. 20, 1999 (FI) ..... 19992725

(51) Int. Cl.[7] ..... D21F 1/66

(52) U.S. Cl. ..... 162/190; 162/264; 162/183; 162/202; 162/289; 162/336

(58) Field of Search ..... 162/190, 264, 162/183, 202, 289, 336

(56) References Cited

U.S. PATENT DOCUMENTS

| | | | | |
|---|---|---|---|---|
| 5,753,081 A | | 5/1998 | Graf | |
| 6,203,667 B1 | * | 3/2001 | Huhtelin | 162/253 |
| 6,267,845 B1 | * | 7/2001 | Hautala et al. | 162/183 |

FOREIGN PATENT DOCUMENTS

| | | |
|---|---|---|
| DE | 199 23 149 A1 | 11/2000 |
| WO | WO 99/64668 | 12/1999 |

* cited by examiner

*Primary Examiner*—Peter Chin
*Assistant Examiner*—Mark Halpern
(74) *Attorney, Agent, or Firm*—Nixon & Vanderhye P.C.

(57) ABSTRACT

The present invention relates to a method of and an apparatus for controlling the operation of the short circulation of a paper, paper board or the like production machine. The method and apparatus according to the invention are especially preferably suitable for use in the approach system, i.e. so-called short circulation, of said production machines for regulating the headbox feed pressure. A characteristic feature of the method and apparatus according to the invention is that at a suitable location in the approach system of said production machine there is arranged a controllable parallel flow, by means of which at least one flow in the approach system is regulated so that the pressure in the headbox remains essentially constant.

11 Claims, 3 Drawing Sheets

Figure 1:
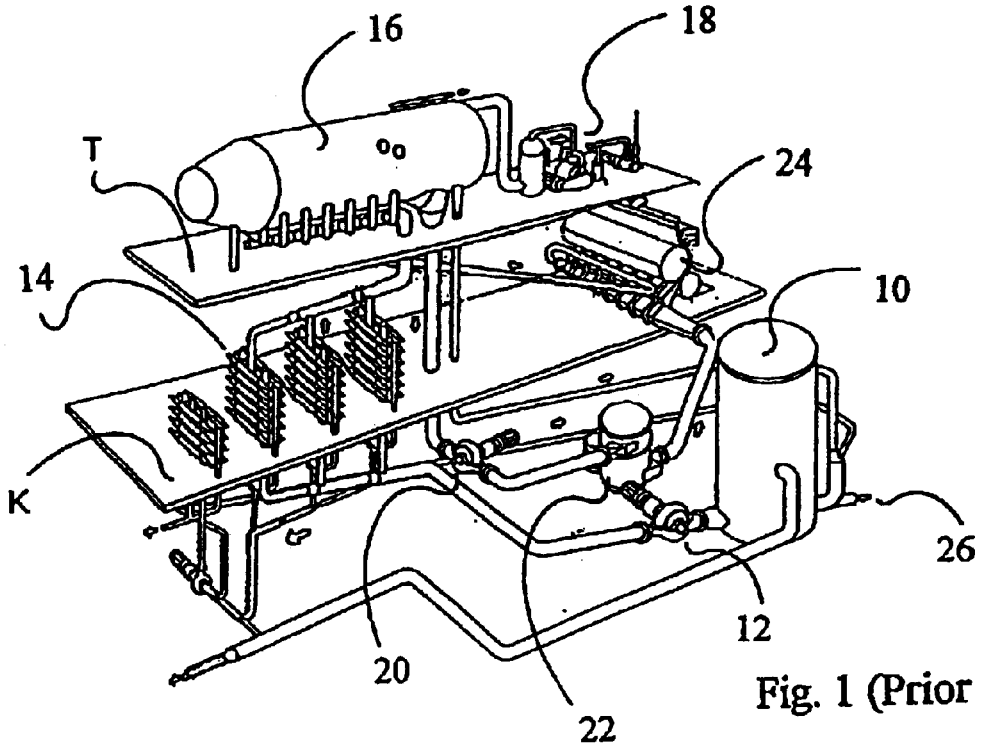
Fig. 1 (Prior art)

METHOD AND APPARATUS FOR CONTROLLING THE OPERATION OF THE SHORT CIRCULATION OF A PAPER, PAPERBOARD OR THE LIKE PRODUCTION MACHINE

The present invention relates to a method and apparatus for controlling the operation the short circulation of a paper, paperboard or the like production machine. Especially preferably the method and apparatus according to the invention are suitable for use in the approach system, i.e. so-called short circulation, of said production machines. To put it more precisely, the objective of the invention is to keep the headbox feed pressure constant.

Almost all prior art paper machine approach systems feeding pulp to a paper machine or the like, which are well described in e.g. U.S. Pat. No. 4,219,340, comprise the following components: a white water tank, a centrifugal cleaning plant with its feeding pumps and pumps between various stages, a gas separation tank with its vacuum apparatus, a headbox feed pump, a headbox screen, a paper machine headbox and white water trays. Said components are placed in connection with the paper machine and arranged to operate as follows: The fiber material used for paper making and the fillers, which are diluted with so-called white water obtained from the wire part of the paper machine, are dosed by means of a basis weight regulation valve into the white water tank usually located at the bottom level of the mill. By means of a feed pump also located at the bottom level of the mill, the fiber suspension is pumped from the white water tank to the first cleaning stage of the centrifugal cleaning plant located usually at the machine level of the mill, i.e. the location level of the paper machine, or, as in said patent, above it. Most often the centrifugal cleaning plant comprises several (most commonly 4–6) stages, each typically provided with its own feed pump. By means of pressure created by said feed pump, the fiber suspension accepted by the first cleaning stage of the centrifugal cleaning plant is further conveyed to the gas separation tank typically located at a level above the machine level. In some cases, when there is no gas separation tank, the accept from the centrifugal cleaning plant is further transported directly into the headbox or after intermediate dilution to the headbox feed pump. In the gas separation tank the fiber suspension is subjected to the effect of vacuum created by vacuum devices, most commonly liquid ring pumps, whereby both part of the gas dissolved in the suspension and the gas present in the suspension in form of small bubbles rises above the liquid level of the tank and is removed from the tank via the vacuum devices. From the gas separation tank the fiber suspension, outgassed as thoroughly as possible, flows to the headbox feed pump located at the bottom level of the mill, which feed pump pumps the fiber suspension to the headbox screen (not shown in said US patent) also located at the bottom level, wherefrom the fiber suspension flows to the machine level into the paper machine headbox.

One problem in both the above described and other prior art paper machine approach systems is that the pressure of the pulp in the headbox is prone to some fluctuations. There are many reasons for this. One reason is created by the sometimes great variations in the density of the pulp in the gas separation tank, whereby the pressure of the suction side of the headbox feed pump varies according to the density variations of the pulp. This is the case especially when the gas separation is arranged by means of a gas separation tank provided with an overflow for maintaining a constant surface level of the suspension in the tank. Another reason is created by gas separation tanks without overflow, in which the surface level is allowed to vary within certain limits. In some cases the surface level regulation system, while keeping the surface level essentially constant, does not react to the changes in the density of the pulp. Nevertheless, in both cases the inlet pressure of the headbox feed pump changes. Unless this change in the inlet pressure is taken into account, the headbox pressure changes accordingly.

Other reasons for pressure variations are e.g. swaying operation of the headbox feed pump, pulse-generating piping or apparatuses in the piping. As an example of process apparatuses, the headbox screen and the variations or swaying in the reject amount therefrom may be mentioned. Further, without gas removal, the amount of gas in the suspension creates pulsation, too.

Prior art knows attempts to regulate the headbox pressure either by means of two parallel valves positioned in the headbox feed line or a return valve connected parallel to the headbox feed pump. In both cases, power losses may turn out to be relatively great. This is the case especially when using two parallel valves, whereby both flows are being throttled. Additionally, strong throttling in the valves may cause turbulence and cavitation, which in turn may result in pressure shocks which disturb the operation of the headbox. Thus, locating the regulation valves in the mainline of the flow leading to the headbox may cause unforeseeable problems.

Such problems with valves used to bleed off pressure fluctuations of the fiber suspension have also been recognized in U.S. Pat. No. 5,753,081. It is believed that the continues adjusting of the valve when used as an active pressure attenuator results in a relatively short life span thereof. U.S. Pat. No. 5,753,081 discloses the use of a substantially pulseless pump to transport a variable volume of the fiber suspension away from the headbox feed conduit, dependant upon the sensed pressure in the headbox. The pulseless pump having a variable operating speed is connected to the fluid conduit between the feed pump and the headbox.

It is not easy to fulfill the requirement of the paper maker about the headbox pressure staying as constant as possible, especially by means of older approach system apparatuses. Problems occur also in more modern apparatuses, specifically in connection with gas separation tanks without overflow and/or when the density of the suspension varies. In the headbox pressure regulation systems of prior art, the rotational speed of the headbox feed pump is regulated in an attempt to keep the headbox pressure constant.

One example of such pressure regulation systems has been described in WO-A1-9964668 in which the dilution of the stock to the headbox consistency takes place in two stages. The first stage has an invariable flow, and in the second stage the flow is regulated by means of a control signal received from the headbox pressure regulation. After metering the component stocks and mixing them with dilution water an invariable volume is pumped, by means of the first pump in the main line, constantly to stock cleaning and to the dilution of the second stage. The dilution in the second stage is carried out at the suction side of the second feed pump connected in series with the first pump in the main line. The regulation of the pressure in the headbox controls the speed of rotation of the second feed pump in the main line. WO-A1-9964668 also includes a modification for the application of fibres in layers. The component stocks can be metered in the desired proportions in to the middle layer in the web and into the surface layers in the web if multiple separate main lines are used.

One additional problem may be considered to be arranging the relatively large-sized headbox feed pump to have adjustable rotational speed so as to react even to small changes quickly and sensitively enough. If the actual large-sized headbox feed pump were regulated in an attempt to make it respond quickly to changes in the process, the motor or transmission of the pump would not stand great loadings. Fast changes in the rotational speed of a large-sized pump, i.e. either acceleration or deceleration, subject the motor and transmission to immense loading.

Solving e.g. said problems is the objective of the method and apparatus according to the present invention, a characteristic feature of which is that at a suitable location in the paper machine approach system there is arranged a controllable parallel flow, in connection with which flow there is an actuator having an adjustable flow capacity, by means of which actuator at least one flow in the approach system is regulated so that the pressure in the headbox remains essentially constant.

Typically, the parallel flow is essentially smaller than the main flow.

Other characteristic features of the method and apparatus according to the invention are disclosed in the appended claims.

Figure 2:
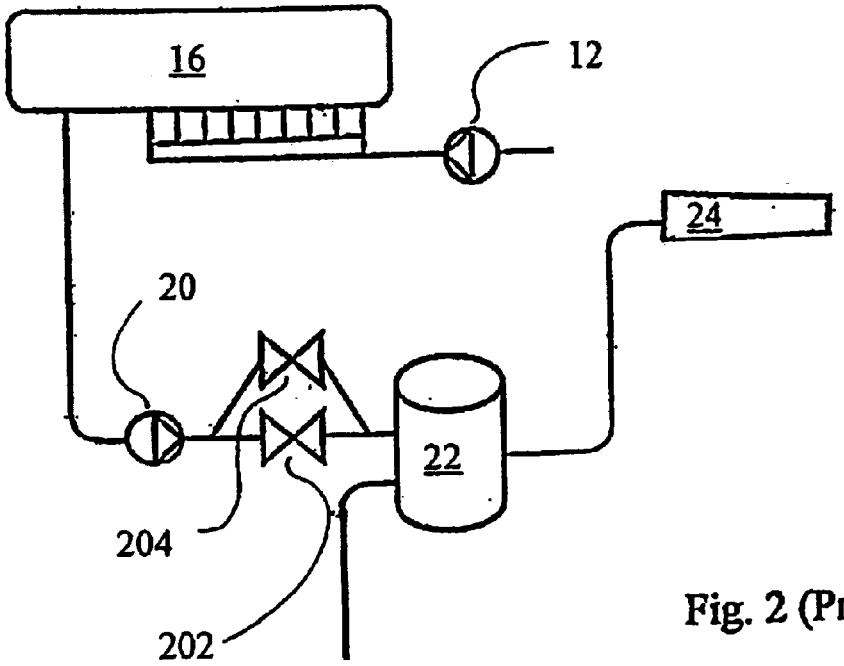
Fig. 2 (Prior art)
Figure 3:
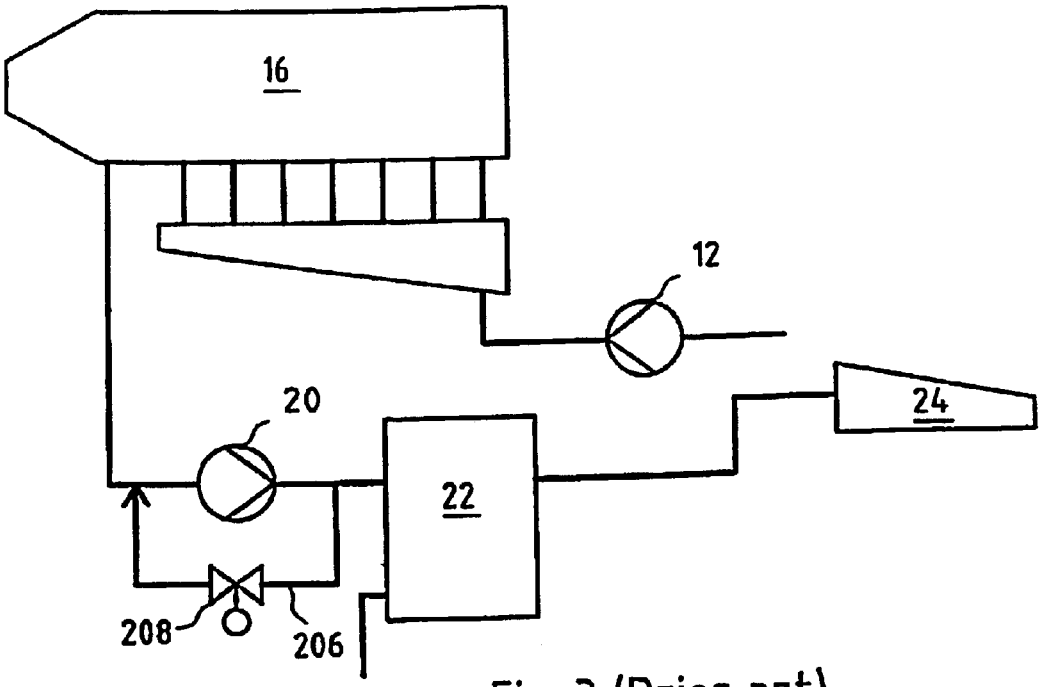
Fig. 3 (Prior art)
Figure 6:
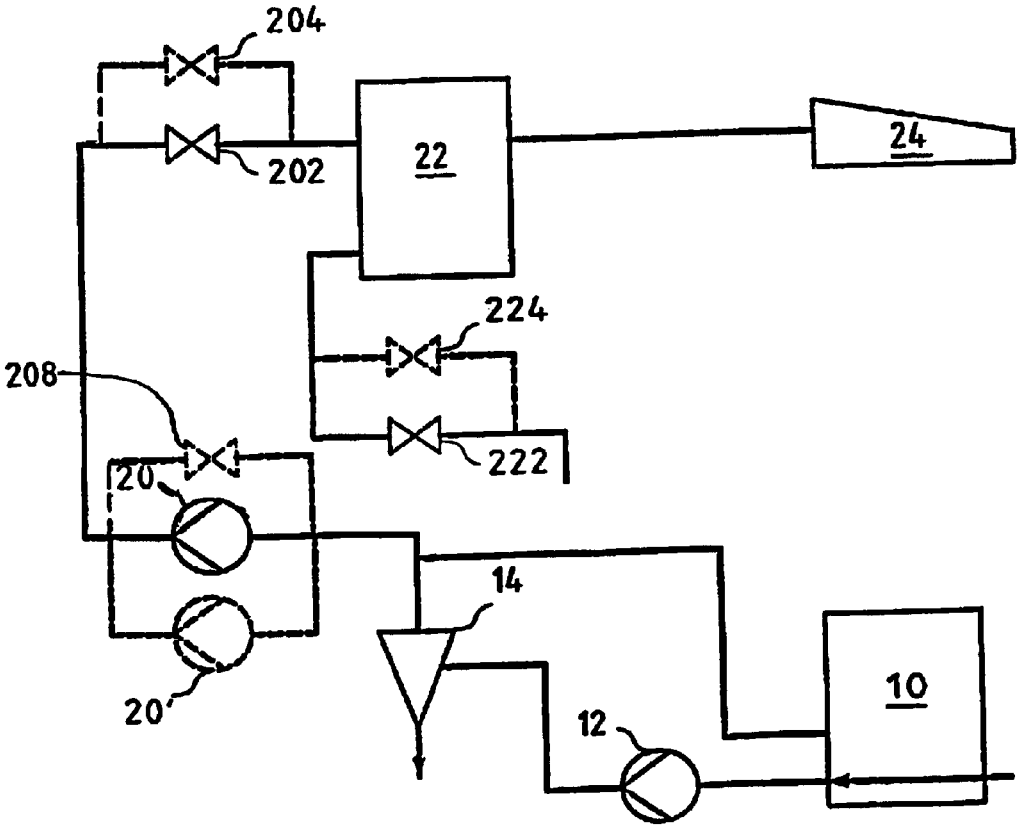
Figure 4:
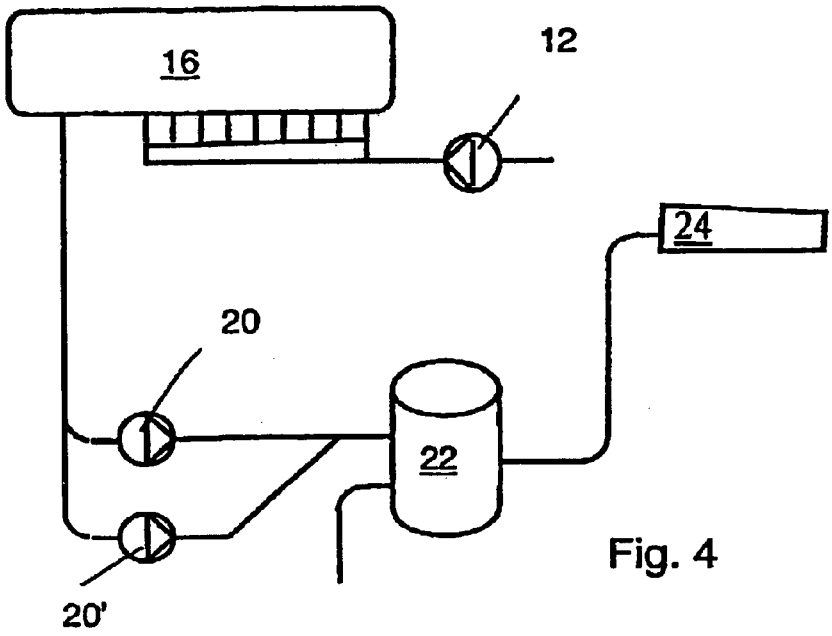
Figure 5:
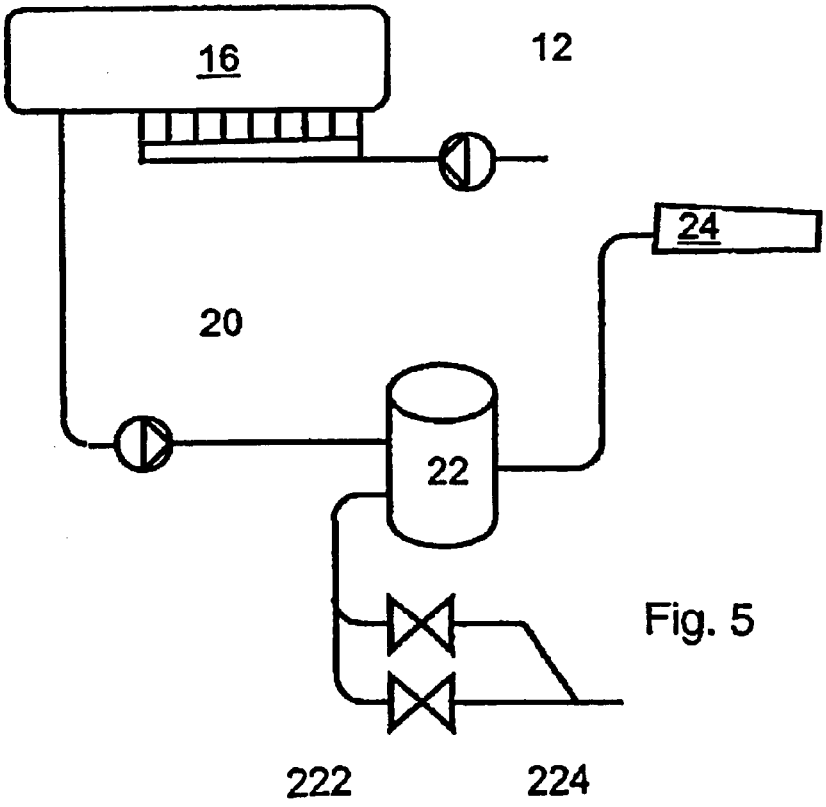

In the following, the method and apparatus according to the invention are explained in more detail with reference to the appended figures, of which FIG. 1 illustrates a prior art paper machine headbox approach system, FIG. 2 illustrates a prior art headbox feed pressure regulation system, FIG. 3 illustrates another prior art headbox feed pressure regulation system, FIG. 4 illustrates schematically a solution according to a preferred embodiment of the invention applied to an approach system of a production machine provided with a gas separation tank, FIG. 5 illustrates schematically a solution according to another preferred embodiment of the invention, and FIG. 6 illustrates schematically a solution according to a third preferred embodiment of the invention.

About the following description of the invention we note at this stage already that it describes the invention in connection with the paper machine only, although it is clear that the invention is applicable to be used in connection with all production machines in which by means of said production machine the web is formed by means of a headbox, in which headbox the pressure should be maintained as constant as possible. Thus, in addition to paper machines, at least various paper board machines and e.g. machines producing glass fiber cloth are in question, without excluding any other options.

The prior art paper machine approach system illustrated in FIG. 1 comprises a white water tank 10, a mixing pump 12, a centrifugal cleaning plant 14 with multiple stages, a gas separation tank 16 with vacuum devices 18, a headbox feed pump 20, a headbox screen 22, a paper machine headbox 24 and white water trays (not shown). Said components are placed in connection with the paper machine and arranged to operate as follows. The fiber material used in paper making, which may comprise fresh stock, secondary pulp and/or broke, and the fillers, which are diluted with so-called white water obtained from the paper machine, primarily its wire part, are dosed from the machine chest via flow path 26 into the white water tank 10, wherein white waters are collected and which in prior art systems is usually located at the bottom level of the mill, to produce paper pulp. By means of a mixing pump 12 also located at the bottom level of the mill said paper pulp is pumped from the white water tank 10 to a centrifugal cleaning plant 14 usually located at the machine level K (the level of the paper machine with its headbox) of the mill, which cleaning plant most usually comprises 4–6 stages. Paper pulp accepted by the centrifugal cleaning plant 14 is transferred further under pressure created by the mixing pump 12 and assisted by the vacuum of the gas separation tank 16 into the gas separation tank 16 located at a level T above the machine level. The gas separation tank 16 typically comprises an overflow, by means of which the surface level of the pulp in the tank is maintained constant. Paper pulp removed from the tank 16 by means of the overflow flows via tube 28 down under the machine level K into the white water tank 10 located at the bottom level of the mill. From the gas separation tank 16 the essentially gas-free paper pulp, i.e. pulp from which gas is removed by means of vacuum apparatus 18 as thoroughly as possible, flows to the headbox feed pump 20 located at the bottom level of the mill, which pump pumps the paper pulp to the headbox screen 22 also located at the bottom level of the mill, wherefrom the accepted paper pulp flows to the machine level K into the paper machine headbox 24. As already stated, the headbox feed pump 20 is most often one with adjustable rotational speed. The feed pump used is most usually a centrifugal pump, although the propeller pump described in FI patent application 981798 is gaining popularity in the market.

FIG. 2 illustrates a prior art method of regulating the headbox pressure. In the method of regulating the headbox pressure illustrated in the figure, there are two valves 202 and 204 connected in parallel between the feed pump 20 and the headbox screen 22. The main principle is that in a normal state the adjustment of valve 202 remains untouched, whereby the flow passing through the valve, actually only throttling, is constant. When there is a need to change the headbox pressure, the valve 204 is adjusted. If pressure increase is desired, the valve 204 is opened, and if pressure decrease is desired, the flow is throttled by said valve 204. Problems arise e.g. due to the fact that in almost every case both valves operate under throttling, thus causing power losses. A further risk is that especially valve 204, effecting the actual regulation taking place during operation, is in some operational stage under intense throttling, whereby the throttling generates turbulence, cavitation and pressure shocks extending to the headbox.

FIG. 3 illustrates a second prior art method of regulating the headbox feed pressure. In that method, parallel to the headbox feed pump 20 there is a return circulation pipe 206 arranged and provided with a valve 208. By regulating the return circulation by means of the valve 208, the headbox 24 feed pressure may be effected very quickly. Opening the valve decreases the feed pressure and closing the valve increases the feed pressure. This valve causes exactly the same kind of problems as the solution presented in FIG. 2. That is, both power losses and pressure shocks.

In practice, if the valve is to be used for regulating the headbox feed pressure in all situations, the return circulation should in a normal running operation be about 0.5–15%, preferably 0.5–3% of the capacity of the headbox feed pump i.e. volume flow.

FIG. 4 illustrates a solution according to a preferred embodiment of the invention combined to a conventional prior art paper machine approach system. Where applicable, the figure uses the same reference numbers as in FIG. 1. The solution of FIG. 4 differs from the prior art solution only by having another feed pump 20', essentially smaller that the first pump, connected parallel to the headbox feed pump 20. Preferably the second pump 20' has a capacity of 0.5–15% of the so-called main pump. More preferably the capacity of the second pump is in the order of 0.5–3% of the capacity of the main pump, that is, a pump essentially smaller than the main pump is adequate. The object of the solution according to the figure is to ensure that the so-called main pump 20 operates all the time at a constant rotational speed having a capacity that is somewhat smaller than the pulp flow required by the paper machine. The so-called main pump is preferably one with adjustable rotational speed, too, but as its adjustment is essentially slower than the adjustment of the second, smaller pump, it is used only during changes in large flow amounts, e.g. grade changing and changes in the production amount. The second, so-called parallel pump 20' also has adjustable rotational speed, whereby by changing the rotational speed of said pump—changes in speed quickly compensate for pressure changes in the headbox—it is possible to keep the feed pressure of the paper machine headbox constant. One advantage of the solution according to this embodiment of the invention is, that it provides the paper machine approach system with a mobile adjustable pump 20' which is capable of compensating pressure changes in the headbox feed essentially better than prior art apparatuses. Another advantage is that with a smaller pump 20', small-scale adjustment is remarkably easier than with a bigger pump 20, which results in an essentially improved accuracy in the pressure regulation of the headbox 24. Naturally, all expenses relating to the purchasing, installation and use of a smaller pump are decreased in proportion to the size of the pump. Correspondingly, a smaller pump facilitates quicker response to changes in the flow space.

Another method of solving essentially the same task is to arrange the smaller pump to rotate at a constant rotational speed and arrange a regulation valve in series with said pump, preferably at the pressure side of the pump, by means of which regulation valve the partial flow through the pump may be regulated if necessary.

FIG. 5 illustrates a solution for regulating the headbox pressure according to another preferred embodiment. In said embodiment, the pressure of the headbox 24 is regulated by regulating the reject flow of the headbox screen 22. In the conventional prior art solution, in the reject line of the headbox screen 22 there is one valve 222, by means of which the reject flow is kept constant, i.e. the valve is usually not regulated during the run. In this embodiment of our invention, in the reject line of the headbox screen 22 there are arranged two parallel connected adjustable valves 222 and 224. In practice, the valve 222 is kept in a constant position after the main amount of reject has been regulated, as stated above, whereby the reject flow through said valve is constant. By means of the other valve 224, the reject flow therethrough is regulated, whereby opening the valve 224 increases the reject flow resulting in pressure decrease both over the screen surface of screen 22 and in the headbox 24. Correspondingly, by throttling the valve 224 it is possible to increase the pressure both in the screen 22 and the headbox 24. When having these valves positioned in the reject line of the headbox screen, the power loss of throttling is in practice non-existing compared to losses when throttling the main flow. Accordingly, as the reject flow is relatively moderate, pressure shocks are not likely to be generated therein.

FIG. 6 in turn illustrates in one and the same figure the solutions of both the above-presented embodiments in an approach system devoid of a gas separation tank. Naturally, it has to be remembered that this figure does not by any means suggest that several different regulation systems for regulating the headbox feed pressure would be needed at the same time, but these are presented in the same figure only in purpose of restricting the number of figures. On the other hand, there are no limitations for the use of several regulation methods at the same time, if considered necessary.

As noted from the above, a new kind of regulation method and apparatus for the paper machine approach system have been developed which eliminate many weaknesses and disadvantages of prior art and solve problems that have been disturbing the use of prior art approach systems. It has to noted from the above, though, that the invention is not restricted to any specified form or type of a gas separation device. Thus, the gas separation device may be a conventional gas separation tank, but just as well it may be some combination of a centrifuge and a pump, which have presently been suggested for gas separation purposes in the paper machine short circulation. Neither is our invention restricted to any specific pump or valve type. In other words, the pump to be used in the, system may be a usual centrifugal pump, but other kinds of pumps, as e.g. propeller pumps may well be used as well.

What is claimed is:

1. Method of controlling the operation of the short circulation of a paper, paper board or other web-forming production machine, according to which method the pulp to be used for forming fiber web is pumped from the so-called short circulation to the headbox (24) of said production machine, and the flow going to the headbox is divided to at least two partial flows, at least one of which is altered to regulate the feed pressure of the headbox (24), characterized in that each of the at least two partial flows is directed in parallel to a separate feed pump (20, 20') of the headbox (24), whereby the partial flow through at least one of the pumps (20') is adjustable.

2. Method according to claim 1, characterized in that the partial flow through said at least one of the pumps (20') is regulated by means of a valve.

3. Method according to claim 1, characterized in that the rotational speed of said at least one of the pumps (20') is adjustable.

4. Method according to claim 1, characterized in that the feed pressure of the headbox (24) is changed by changing the partial flow through said at least one of the pumps (20').

5. Method according to claim 1, characterized in that the partial flow through said at least one of the pumps (20') is about 0.5–15% of the main flow, preferably 0.5–3% of the main flow.

6. Method according to claim 1, characterized in that the short circulation is provided with a gas separation stage, whereby the object of said regulation operations is the flow going from the gas separation to the headbox.

7. Apparatus for controlling the operation of the short circulation of a paper, paper board or other web-forming production machine, which short circulation of said production machine comprises at least a headbox (24) of said production machine and a feed pump (12, 20) for feeding paper, paper board or the like pulp to be used for forming fibre web towards the headbox (24) and means for dividing the flow to the headbox to two partial flows, characterized in that there is arranged a second pump (20') parallel to the feed pump (20) of the headbox (24), whereby the partial flow through the second pump (20') to the headbox (24) is regulated.

8. Apparatus according to claim 7, characterized in that there is a regulation valve connected in series with the second pump (20').

9. Apparatus according to claim 7, characterized in that said second pump (20') is one with adjustable rotational speed.

10. Apparatus according to claim 8, characterized in that the short circulation of said production machine comprises devices (16) for separating gas from the pulp and that said second pump (20') and the regulation valve are arranged between said gas separation device (16) and the headbox (24) of the production machine.

11. Apparatus according to claim 9, characterized in that the short circulation of said production machine comprises devices (16) for separating gas from the pulp and that said second pump (20') with adjustable rotational speed is arranged between said gas separation device (16) and the headbox (24) of the production machine.

* * * * *